US007746280B2

(12) United States Patent
Kim et al.

(10) Patent No.: US 7,746,280 B2
(45) Date of Patent: Jun. 29, 2010

(54) MOBILE TERMINAL USING AN INTERNAL ANTENNA WITH A CONDUCTIVE LAYER

(75) Inventors: Chang-II Kim, Gyeonggi-Do (KR); Sung-Shin Kong, Incheon (KR)

(73) Assignee: LG Electronics Inc., Seoul (KR)

( * ) Notice: Subject to any disclaimer, the term of this patent is extended or adjusted under 35 U.S.C. 154(b) by 430 days.

(21) Appl. No.: 11/758,748

(22) Filed: Jun. 6, 2007

(65) Prior Publication Data

US 2007/0296638 A1 Dec. 27, 2007

(30) Foreign Application Priority Data

Jun. 23, 2006 (KR) ..... 10-2006-0057139

(51) Int. Cl.
*H01Q 1/24* (2006.01)
*H01Q 1/38* (2006.01)
*H01Q 19/10* (2006.01)

(52) U.S. Cl. ..... 343/702; 343/700 MS; 343/818

(58) Field of Classification Search ..... 343/700 MS, 343/702, 818, 846
See application file for complete search history.

(56) References Cited

U.S. PATENT DOCUMENTS 4,431,998 A * 2/1984 Finken ..... 343/797
5,266,109 A * 11/1993 Voelker et al. ..... 106/459
5,809,433 A 9/1998 Thompson et al.
7,053,841 B2 * 5/2006 Ponce De Leon et al. ... 343/702
7,415,248 B2 * 8/2008 Andersson et al. ..... 455/90.3
2003/0137458 A1 7/2003 Troelsen
2005/0024272 A1 2/2005 Ponce De Leon et al.

OTHER PUBLICATIONS

Kingsley S: "Advances in Handset Antenna Design" RF Design, Primedia Business Magazines & Media, Overland Park, KS, U.S., vol. 28, No. 5, May 2005, p. 16, 18, 20, 22, XP001242240 ISSN: 0163-321X *p. 16, col. 3, lines 4-6*.

* cited by examiner

*Primary Examiner*—Shih-Chao Chen
(74) *Attorney, Agent, or Firm*—Lee, Hong, Degerman, Kang & Waimey

(57) ABSTRACT

A mobile communication terminal may be made smaller by using an internal antenna and a conductive layer. The conductive layer is spaced apart from the antenna by a fixed gap, and the conductive layer may be located either internally or externally to the terminal housing. The addition of the conductive layer provides a second resonant frequency in a higher frequency band than a first resonant frequency. Because the conductive layer has a relative smaller amount of radiation and is more directly affected by a human body than the internal antenna with a relatively larger amount of radiation, the performance characteristics of the terminal can be increased by a corresponding amount.

15 Claims, 8 Drawing Sheets

MOBILE TERMINAL USING AN INTERNAL ANTENNA WITH A CONDUCTIVE LAYER

CROSS-REFERENCE TO RELATED APPLICATIONS

This non-provisional application claims priority under 35 U.S.C. §119(a) on Patent Application No. 10-2006-0057139 filed in Korea on Jun. 23, 2006, the entire contents of which are hereby incorporated by reference.

FIELD OF THE INVENTION

The present invention relates to a mobile communication terminal having an internal antenna capable of reducing an influence of human body contact.

DESCRIPTION OF THE RELATED ART

Mobile communication terminals are becoming lighter and smaller allowing users to simply carry them around, but the terminals are still required to provide sufficient mechanical support and to obtain quality communication implementing various functions within the small and limited terminals.

An external antenna was initially developed for use for radio communications of mobile communication terminals. However, external antennas are disadvantageous in that they degrade the appearance of the terminals and can be easily damaged. To overcome these disadvantages, internal or imbedded antennas have been developed.

An example of a terminal having an internal antenna will now be described with reference to FIG. 1, a partial sectional view of the related art terminal. The related art terminal 1 having an internal antenna includes a main body 2 having a key button 6 installed on its upper surface, and a folder body 3 rotatably connected with the main body 2 such that it can be opened and closed with respect to the main body 2. A battery 5 is installed at a lower side of the main body 2, and a circuit board 4 on which various control and communication components are mounted is installed within the main body 2.

A Planar Inverted F-Antenna (PIFA) antenna 7, a type of internal antenna, is installed at one side of the circuit board 4. The antenna 7 includes a radiator 8 and a dielectric spacer 9 that supports the radiator 8 at a certain distance from a ground surface of the circuit board 4.

The radiator 8 is influenced by other components or metals and such components or metals may easily and directly affect antenna transmission or reception performance. For this reason, metal components are not mounted near the radiator 8. Such a restriction may add unnecessary thickness to the terminal 1.

If the antenna 7 is mounted within the main body 2, the antenna length is constrained and the bandwidth is narrowed. In particular, when the main body 2 needs to be slimmer, antenna designers are limited in their selection.

In addition, as the antenna 7 is mounted internally in the terminal 1, radio performance may be degraded by a user's hand holding the main body 2, or the user's head. To overcome this, the antenna 7 is mounted at a restricted position, such as the corner of the main body 2 as shown in FIG. 1.

SUMMARY OF THE INVENTION

Therefore, in order to address the above matters, the various features of the invention are described herein. One aspect of the embodiments is to provide a mobile communication terminal capable of implementing desired performance in higher radio frequency communication bands while not degrading antenna performance resulting from contact with a user.

A mobile communication terminal includes a terminal housing further comprising a first housing part and a second housing part, a circuit board disposed within the first housing part, an antenna disposed within the terminal housing, the antenna having a first resonant frequency and a second resonant frequency and a conductive layer disposed on the second housing part, wherein the conductive layer is electromagnetically coupled with the antenna.

When the first housing part is coupled to the second housing part, the antenna and the conductive layer are parallel to each other and spaced apart by a fixed gap. The conductive layer is electromagnetically coupled to the antenna. The antenna is attached to the circuit board using a dielectric spacer, and the antenna is electrically connected to the circuit board.

The antenna with the conductive layer has a first resonant frequency in the GSM 900 radio frequency band for wireless communications, and has a second resonant frequency in the GSM 1800 and 1900 radio frequency bands.

The conductive layer may be affixed to the second housing part either on an inside or an outside surface, and if affixed to the outside surface, the antenna may be affixed to the inside surface of the second housing part wherein the second housing part provides a fixed gap between the antenna and the conductive layer. The conductive layer may be affixed to the second housing part using dielectric double-sided tape, by mechanical means, or by applying electromagnetic interference (EMI) pigments directly.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
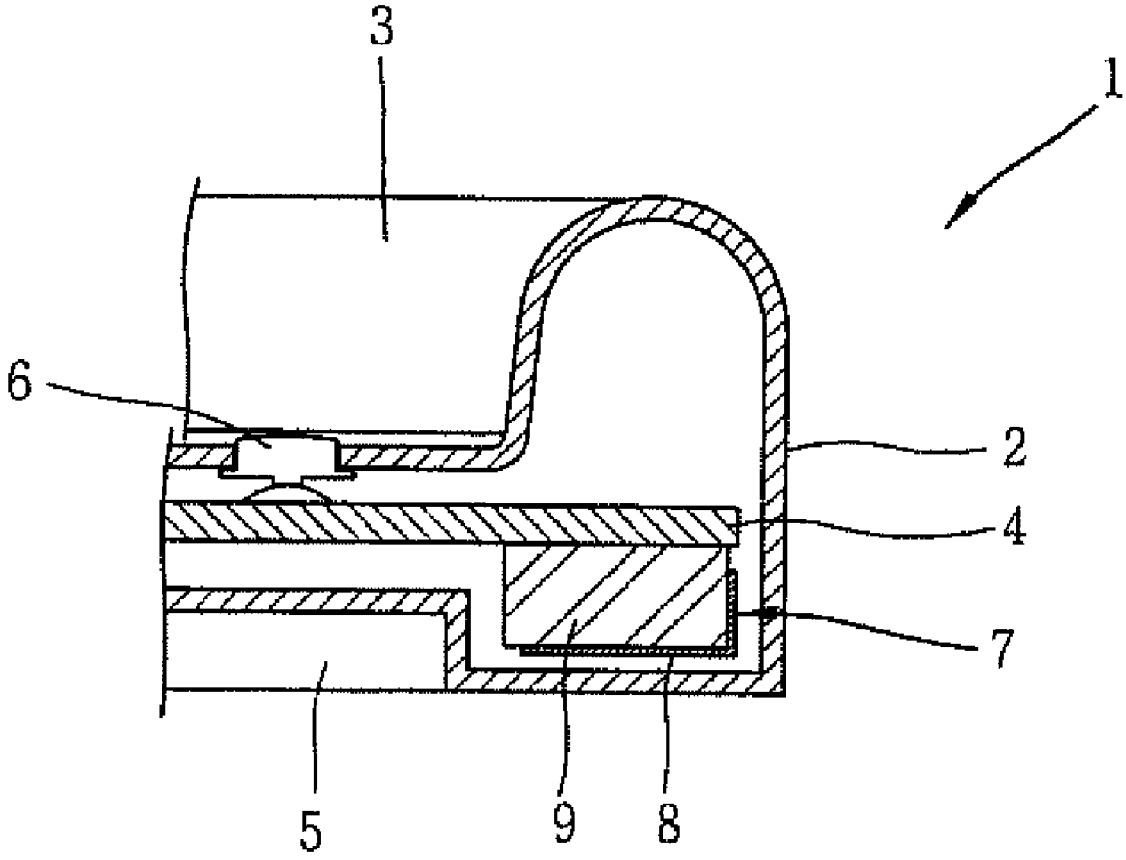
FIG. 1 RELATED ART
FIG. 1 is a partial sectional view of a mobile communication terminal according to the related art.
Figure 2:
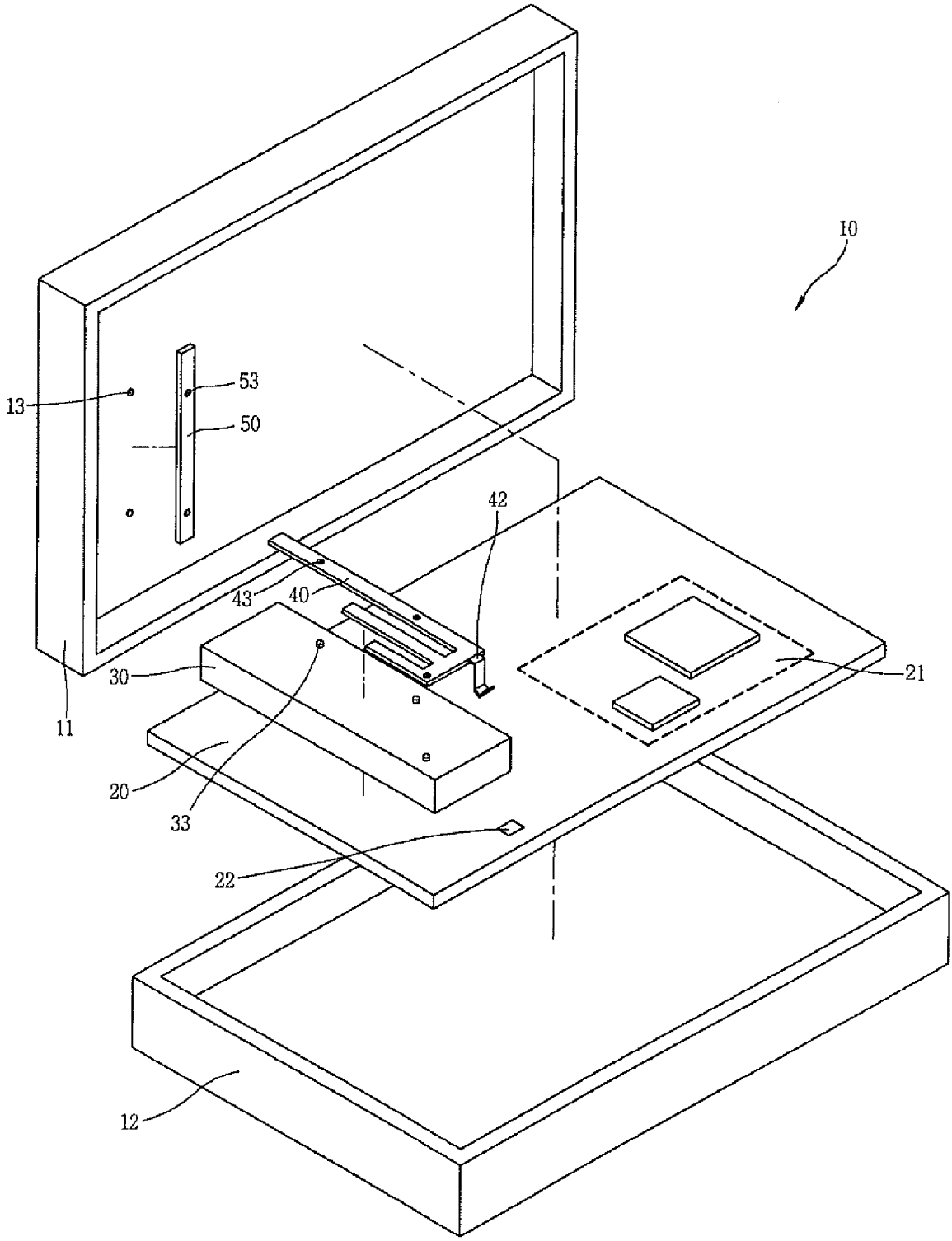
FIG. 2 is an exploded perspective view of a mobile communication terminal according to one embodiment of the present invention.

FIG. 2 is an exploded perspective view of a mobile communication terminal according to one embodiment of the present invention. As shown, the communication terminal 10 includes first and second terminal housings 11 and 12 in which a circuit board 20 is installed, an antenna 40 installed within the terminal housings 11 and 12 and tuned to a resonance frequency of a first band, and a conductive layer 50 mounted on the first terminal housing 11 electromagnetically coupled with the antenna 40 to retune the antenna to have an additional resonance frequency in at least a second band higher than the first band.

A communication module 21 is mounted on the circuit board 20 and transmits, receives, and processes signals to and from the antenna 40. The circuit board 20 provides a ground plane for the antenna 40.

A connection pad 22 connects the circuit board 20 to the antenna 40 by means of a feeding portion 42. The feeding portion 42 can be made of a conductive elastic material.

A spacer 30 is mounted between the antenna 40 and the circuit board 20 for spacing the antenna 40 from the circuit board 20, and can be made from a dielectric material, such as plastic or ceramic.

A plurality of holes 43 are formed on the antenna 40 to allow the antenna 40 to be fixed to the spacer 30, and fixing protrusions 33 are formed on the spacer 30 for insertion into the holes 43 to fix the antenna 40 to the spacer 30. The conductive layer 50 is fixed to the inner surface of the first terminal housing 11.

As shown in FIG. 2, fixing protrusions 13 are formed on the inner surface of the first terminal housing 11, and the through holes 53 are formed on the conductive layer 50, into which the fixing protrusions 13 are inserted. Alternatively, the conductive layer 50 can be attached to the first terminal housing 11 by a dielectric double-sided tape.

The conductive layer 50 is disposed parallel to an extending planar surface of the antenna 40 such that at least a certain portion of the conductive layer 50 overlaps with the antenna 40. In particular, the conductive layer 50 can be movably installed to vary distance from the antenna 40 in order to control a coupling degree with the antenna 40 (refer to FIG. 6).

Figure 3:
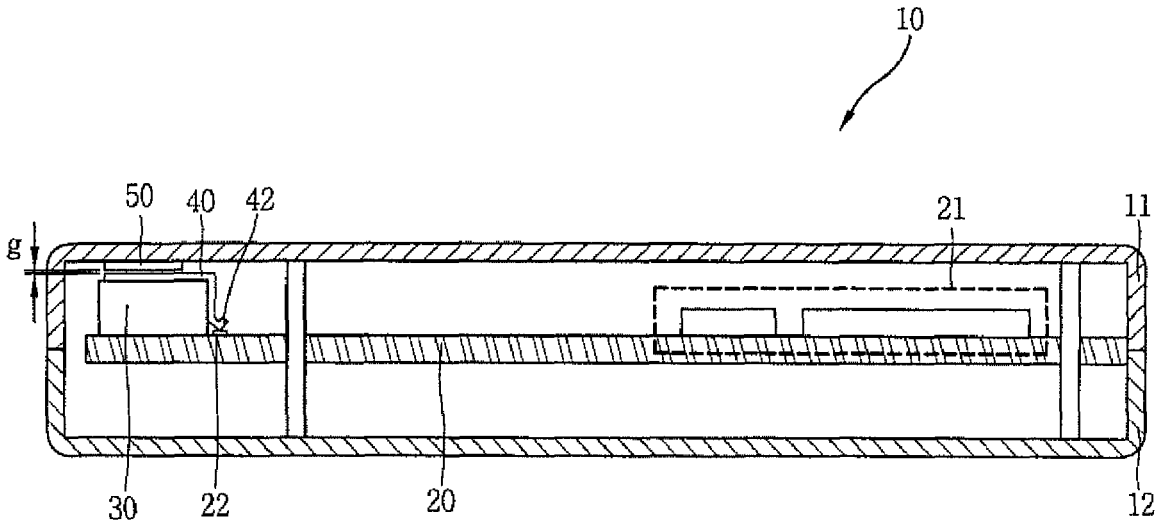
FIG. 3 is a sectional view showing a coupled state of the mobile communication terminal of FIG. 2.

FIG. 3 is a sectional view showing a coupled state of the terminal of FIG. 2. As shown, the conductive layer 50, when fixed to the first terminal housing 11, is spaced apart from the antenna by a gap (g). Alternatively, the gap may be maintained by air or a dielectric such as plastic.

Figure 4:
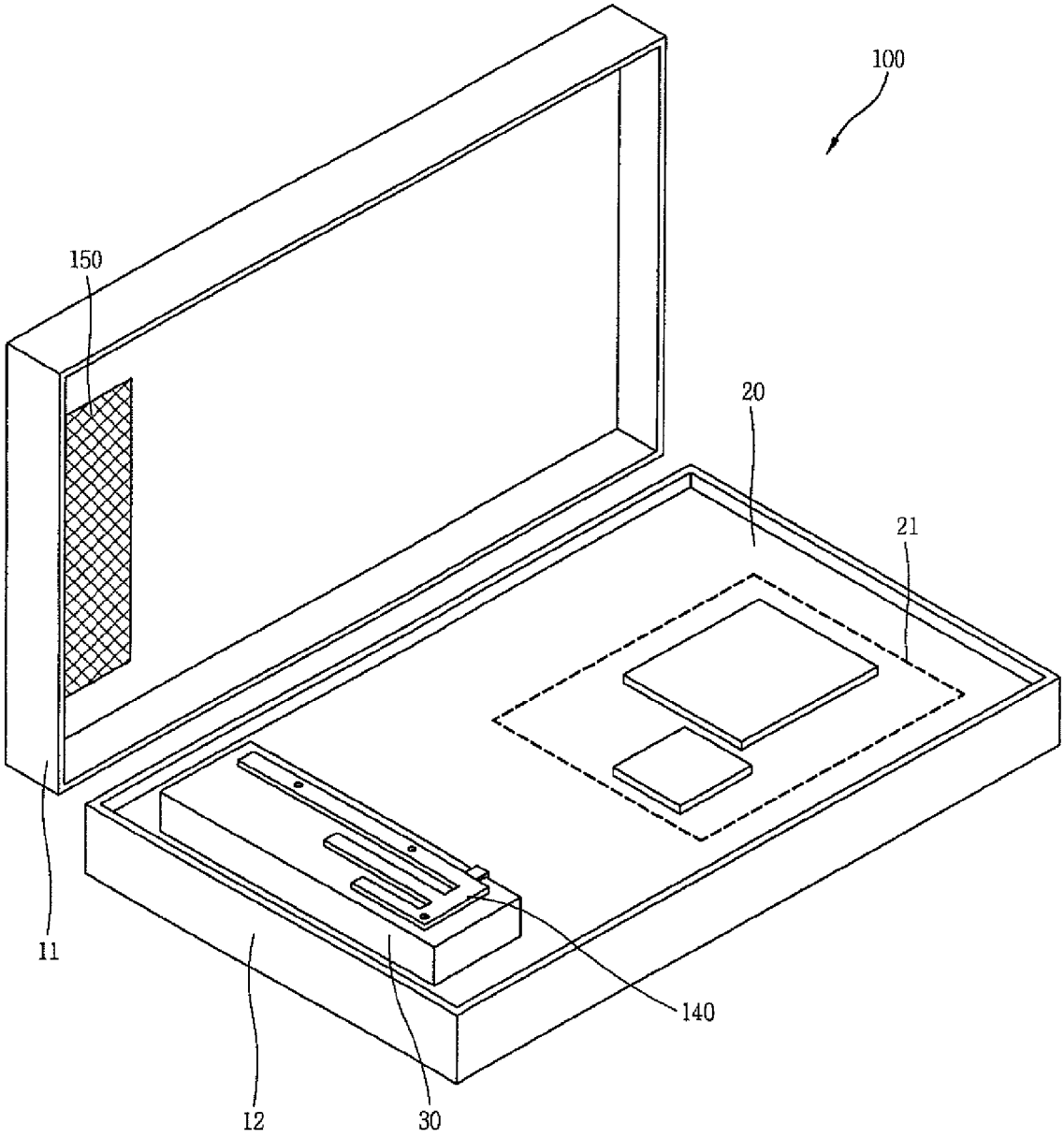
FIG. 4 is an exploded perspective view of a mobile communication terminal according to another embodiment of the present invention.

FIG. 4 is an exploded perspective view of a terminal 100 according to another embodiment of the present invention. As shown, a conductive layer 150 is formed on an inner surface of the terminal housing 11. The conductive layer 150 is formed by coating EMI pigments in a lattice form. Accordingly, coupling of an antenna 140 is induced in the EMI pigments. Other constructions are the same as those of the first embodiment.

Figure 5:
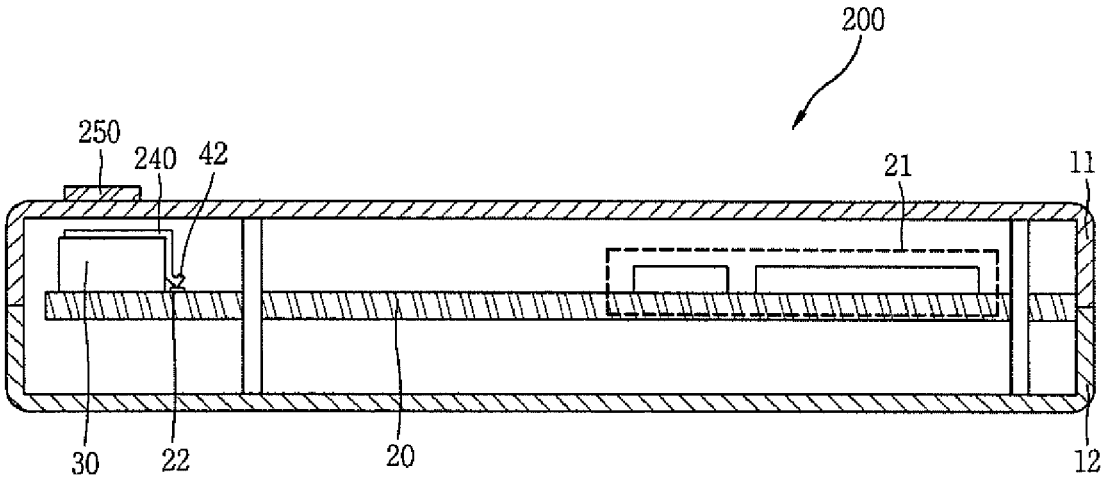
FIG. 5 is a sectional view of a mobile communication terminal according to another embodiment of the present invention.

FIG. 5 is a sectional view of a terminal 200 according to another embodiment of the present invention. As shown, a conductive layer 250 is installed on an outer surface of a terminal housing 11. Accordingly, an antenna 240 is electrically coupled with the conductive layer 250 with the terminal housing 11 interposed therebetween. In this case, the conductive layer 250 is made of a metallic material, such as is used for ornamental decoration.

Figure 6:
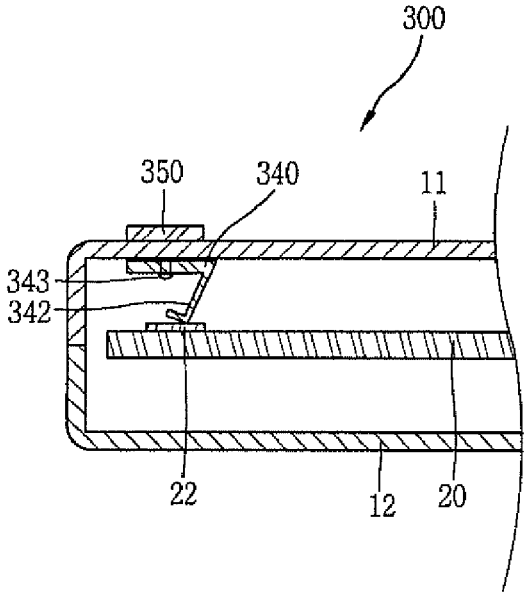
FIG. 6 is a sectional view of a portion of a mobile communication terminal according to another embodiment of the present invention.

FIG. 6 is a sectional view of a portion of a terminal 300 according to another embodiment of the present invention. As shown, an antenna 340 is directly fixed to the terminal housing 11 by a fixing protrusion 343 and contacts with a connection pad 322 of a circuit board 20 by an elastic feeding portion 342. Here, the terminal housing 311 serves as the dielectric between the antenna 340 attached to its inner surface and the conductive layer 350 formed on its outer surface.

Figure 7:
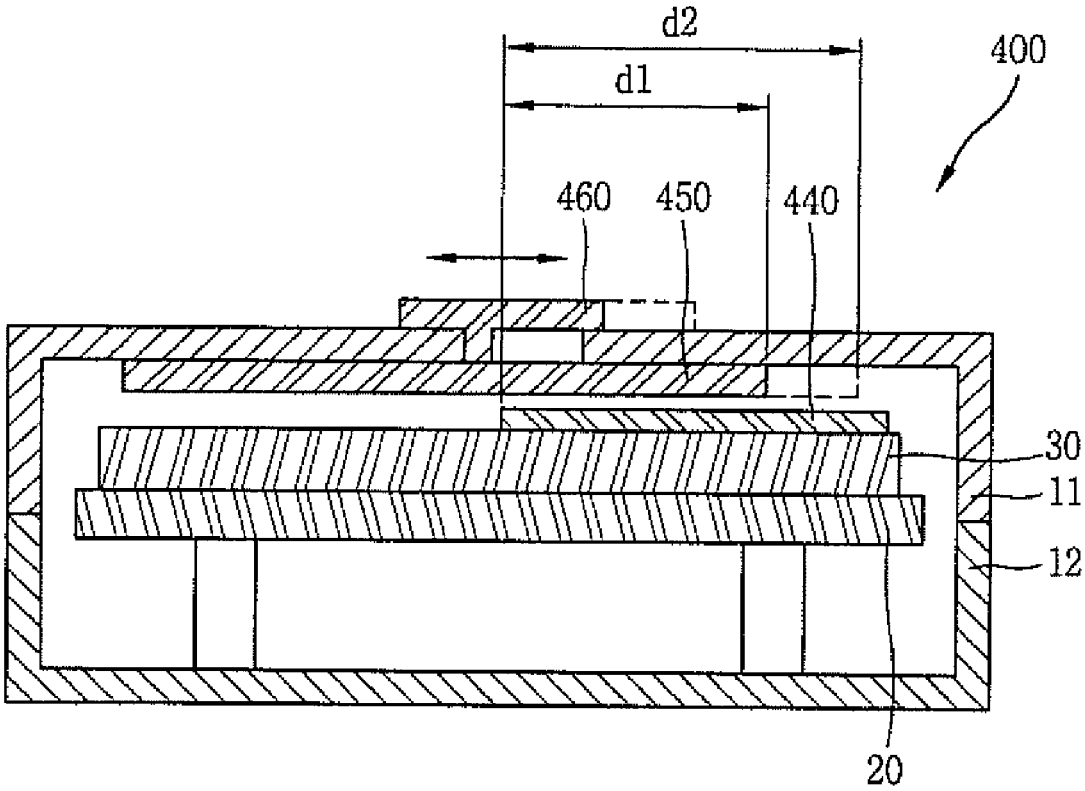
FIG. 7 is a sectional view of a mobile communication terminal according to another embodiment of the present invention.

FIG. 7 is a sectional view of a terminal 400 according to another aspect of the present invention. Here, the conductive layer 450 is connected to a handle 460, exposed to the exterior of a terminal housing 11, and is movable. An overlap of the conductive layer 450 and the antenna 440 is adjustable between distances d1 and d2.

Figure 8:
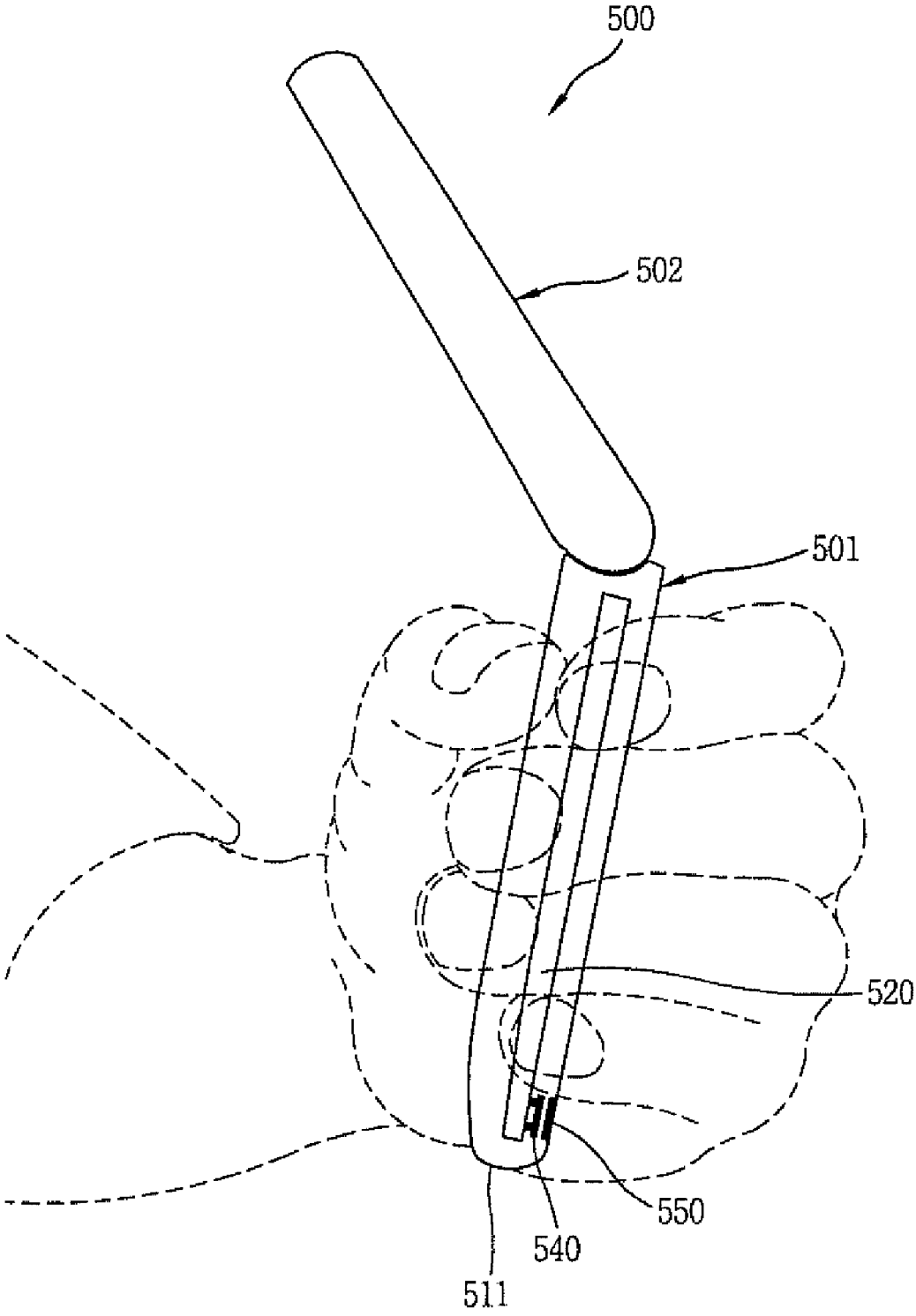
FIG. 8 is a view showing a user holding a mobile communication terminal having a conductive layer coupled with an internal antenna according to another embodiment of the present invention.

FIG. 8 is shows a user holding terminal having a conductive layer coupled with an internal antenna according to this aspect of the present invention. As shown, a terminal 500 includes a first body 501 in which a circuit board 520 is mounted, and a second body 502 rotatably opened and closed with respect to the first body 501. An antenna 540 is installed at a lower portion of the first body 501, and a conductive layer 550, formed on an inner surface of a terminal housing 511 facing user's palm, is coupled with the antenna 540

A radiation pattern around the conductive layer 550 is distorted by the user's hand. Since the antenna 540 providing the main radiation is relatively less affected, the effect of the user's hand on the radiation pattern of the antenna 540 is reduced.

The operation of the mobile communication terminal according to the present invention will now be described.

Figure 9:
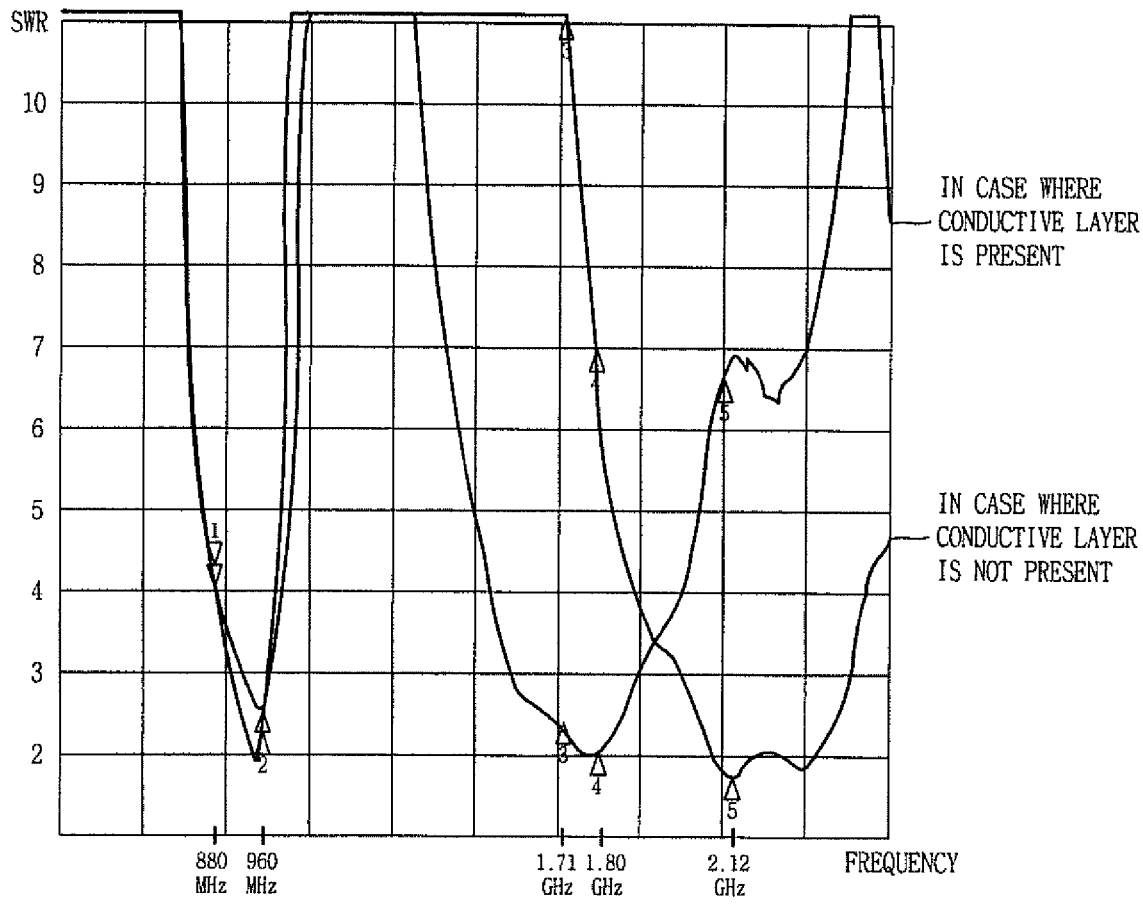
FIG. 9 is a graph of a VSWR (Voltage Standing Wave Ratio) chart showing multiband characteristics covering the GSM900, GSM1800 and GSM1900 bands through the conductive layer coupled with the antenna.

FIG. 9 is a graph of a Voltage Standing Wave Ratio (VSWR) chart showing multiband characteristics covering the GSM 900, GSM 1800, and GSM 1900 bands, through the conductive layer coupled with the antenna.

As shown in FIG. 9, in a first case where there is no conductive layer, it is noted that a first resonance frequency band covers a GSM band having a central frequency of about 900 MHz, and a second resonance frequency band having a central frequency exceeding 2 GHz. A VWSR value exceeding at least 7 is measured at 1.71 GHz and 1.8 GHz indicating that if sufficient space for mounting the antenna is not available within the terminal, desired antenna performance at the higher band cannot be obtained.

In a second case where conductive layers 50, 150, 250, 350, 450 and 550 are coupled with the internal antennas 40, 140, 240, 340, 440 and 540, respectively, the first resonance frequency band is little changed at the GSM900 band while the second resonance frequency band has been shifted to a lower value. Namely, the VWSR values at 1.71 GHz and 1.8 GHz are 2.54 and 2.00, respectively, indicating the GSM 1800 and GSM 1900 bands are sufficiently covered.

Tables 1, 2 and 3 show radiation data in the xy, xz, and yz planes measured at the terminal in the GSM 900, GSM 1800 and GSM 1900 bands according to the present invention.

TABLE 1

| | Gain at GSM 900 band GSM 900 | | | | | |
|---|---|---|---|---|---|---|
| Frequency | Eff1 (xy) | | Eff2 (xz) | | Eff3 (yz) | |
| (MHz) | dBi | % | dBi | % | dBi | % |
| 890 | −1.68 | 42.0 | −1.87 | 40.3 | −3.58 | 27.1 |
| 902 | −0.39 | 44.9 | −0.55 | 43.3 | −2.21 | 29.5 |
| 915 | 0.02 | 46.8 | −0.08 | 45.7 | −1.55 | 32.6 |
| 935 | 0.50 | 49.7 | 0.47 | 49.4 | −0.78 | 36.9 |
| 947 | 0.55 | 50.5 | 0.53 | 50.3 | −0.46 | 39.9 |
| 960 | 0.17 | 49.1 | 0.15 | 48.8 | −0.63 | 40.7 |

As shown in Table 1, the radiation gain at the GSM 900 band is 30% or greater on average, which means that despite the presence of the conductive layers 50, 150, 250, 350, 450 and 550, the antenna performance at the first resonance frequency band is not adversely affected.

TABLE 2

| Frequency | Gain at GSM 1800 band GSM 1800 Eff1 (xy) | | Eff2 (xz) | | Eff3 (yz) | |
|---|---|---|---|---|---|---|
| (MHz) | dBi | % | dBi | % | dBi | % |
| 1710 | −7.79 | 48.8 | −7.79 | 50.4 | −6.16 | 73.4 |
| 1745 | −7.70 | 55.8 | −7.62 | 56.9 | −6.25 | 77.9 |
| 1785 | −7.69 | 44.9 | −7.72 | 44.6 | −6.74 | 55.9 |
| 1805 | −6.22 | 63.2 | −6.28 | 62.4 | −5.47 | 75.2 |
| 1840 | −7.34 | 66.9 | −7.41 | 65.8 | −6.81 | 75.7 |
| 1880 | −4.12 | 68.0 | −4.19 | 66.9 | −3.85 | 72.4 |

TABLE 3

| Frequency | Gain at GSM 1900 GSM 1900 Eff1 (xy) | | Eff2 (xz) | | Eff3 (yz) | |
|---|---|---|---|---|---|---|
| (MHz) | dBi | % | dBi | % | dBi | % |
| 1850 | −4.47 | 70.9 | −4.54 | 69.7 | −4.20 | 75.4 |
| 1880 | −4.12 | 67.9 | −4.19 | 66.8 | −3.85 | 72.3 |
| 1910 | −4.13 | 65.8 | −4.17 | 65.2 | −3.97 | 68.3 |
| 1930 | −4.03 | 63.6 | −4.05 | 63.2 | −3.87 | 65.9 |
| 1960 | −3.41 | 63.1 | −3.45 | 62.4 | −3.24 | 65.6 |
| 1990 | −3.04 | 61.3 | −3.11 | 60.2 | −2.81 | 64.5 |

As shown in Tables 2 and 3, the radiation gains at the DCS1800 and DCS1900 bands are improved by 50% or greater. In particular, the radiation gain at EFF3 is 70% or greater, exhibiting excellent antenna performance.

As described, the mobile communication terminal according to the present invention has at least the following advantages: first, because the conductive layer is installed at the internal antenna within the terminal housing, multiple bands can be covered and the antenna has at least the same or better performance characteristics in a terminal of limited size; second, the conductive layer made of a metal can be mounted as a decorative element on an outer surface of the terminal housing; and third, because the conductive layer with a relative smaller radiation amount is affected more directly by the user's body while the internal antenna with a relatively larger radiation amount is affected less by the user's body, the radio characteristics of the mobile communication terminal can be improved by the corresponding amount.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A mobile communication terminal comprising:

a terminal housing further comprising a first housing part and a second housing part;

a circuit board disposed within the first housing part;

an antenna disposed within the terminal housing, the antenna having a first resonant frequency and a second resonant frequency; and a conductive layer disposed on the second housing part, wherein the conductive layer is electromagnetically coupled with the antenna, wherein the conductive layer is movably affixed to the second housing part and is coupled to a handle exposed to an exterior of the terminal housing, and wherein a portion of the conductive layer overlaps the antenna and the portion of the conductive layer overlapping the antenna is adjustable by manipulation of the handle.

2. The terminal of claim 1, wherein the first resonant frequency is within a first radio frequency communication band, and wherein the second resonant frequency is within a second and a third radio frequency communication band.

3. The terminal of claim 2, wherein the first radio frequency communication band is centered on 900 MHz.

4. The terminal of claim 2, wherein the second radio frequency communication band is centered on 1800 MHz.

5. The terminal of claim 2, wherein the third radio frequency communication band is centered on 1900 MHz.

6. The terminal of claim 1, wherein the antenna comprises a feeding portion electrically connected to the circuit board.

7. The terminal of claim 6, wherein the antenna is affixed to an inside surface of the second housing part, and the feeding portion is electrically connected to the circuit board when the second housing part is coupled with the first housing part.

8. The terminal of claim 7, wherein the conductive layer is affixed to an outside surface of the second housing part, and wherein the second housing part forms a fixed gap between the conducting layer and a planar surface of the antenna.

9. The terminal of claim 1, wherein the antenna is supported on and spaced apart from the circuit board by a dielectric spacer.

10. The terminal of claim 9, wherein the antenna comprises at least one through mounting hole into which at least one fixing protrusion formed on the dielectric spacer is inserted.

11. The terminal of claim 9, wherein the conductive layer is affixed to an inside surface of the second housing part, and wherein the conductive layer is spaced apart by a fixed gap from a planar surface of the antenna when the first housing part is coupled with the second housing part.

12. The terminal of claim 11, wherein the conductive layer is disposed parallel to the planar surface of the antenna.

13. A mobile communication terminal comprising:

a terminal housing further comprising a first housing part coupled to a second housing part;

a circuit board disposed within the first housing part;

an antenna disposed within the terminal housing, the antenna having a first resonant frequency and a second resonant frequency, the first resonant frequency being within a first radio frequency communication band, and the second resonant frequency being within second and third radio frequency communication bands, wherein the second and third radio frequency communication bands have higher central frequencies than a central frequency of the first radio frequency communication band; and a conductive layer disposed on the second housing part and spaced apart and parallel to a planar surface of the antenna when the first housing part is coupled to the second housing part, the conductive layer electromagnetically coupled with the antenna, wherein the conductive layer is movably affixed to the second housing part and is coupled to a handle exposed to an exterior of the terminal housing, and wherein a portion of the conductive layer overlaps the antenna and the portion of the conductive layer overlapping the antenna is adjustable by manipulation of the handle.

14. The terminal of claim 13, wherein the conductive layer is affixed to one of the inside and outside surface of the second housing part.

15. The terminal of claim 14, wherein the antenna is affixed to the inside surface of the second housing part and the conductive layer is affixed to the outside surface of the second housing part.

* * * * *